United States Patent [19]

MacDonald et al.

[11] 3,980,365

[45] Sept. 14, 1976

[54] DRAWER RAIL SYSTEM

[75] Inventors: Francis X. MacDonald, Canton; Paul M. MacDonald, Scituate, both of Mass.

[73] Assignee: P. X. Industries, Inc., Rockland, Mass.

[22] Filed: Apr. 4, 1975

[21] Appl. No.: 565,145

[52] U.S. Cl. ..... 312/345; 312/348; 308/3.6

[51] Int. Cl.[2] ..... A47B 88/00

[58] Field of Search ..... 312/345, 342, 348; 308/3.6

[56] References Cited

UNITED STATES PATENTS

| | | | |
|---|---|---|---|
| 732,721 | 7/1903 | Dunning | 312/348 |
| 1,866,853 | 7/1932 | Kennedy | 312/342 |
| 2,587,691 | 3/1952 | Brewer | 312/348 |
| 2,850,347 | 9/1958 | Lepp | 312/345 |
| 2,985,311 | 5/1961 | Abel | 312/345 |
| 3,090,662 | 5/1963 | Dargene | 312/348 |
| 3,387,906 | 6/1968 | Edwards | 312/342 |
| 3,452,878 | 7/1969 | Smith | 312/345 |
| 3,702,717 | 11/1972 | Gutner | 308/3.6 |
| 3,784,274 | 1/1974 | Holmes et al. | 312/342 |

*Primary Examiner*—Paul R. Gilliam
*Assistant Examiner*—Victor N. Sakran
*Attorney, Agent, or Firm*—Morse, Altman, Oates & Bello

[57] ABSTRACT

A drawer of the sort used in cabinets, desks, files and the like is supported for sliding movement by a single self-aligning center rail. The rail is mounted to the cabinet frame preferably above the drawer, extending from front to back. It is supported at its forward end by a bracket in fixed position and at the rear end by a cup-shaped receptacle allowing limited lateral movement of the rail end. A bifurcated drawer guide is attached at its lower end to the back wall of the drawer and at its upper end slidably engages the rail. The rail is tubular for the major portion thereof while the forward end is flattened to provide a partial stop action for the drawer and also provide means for the drawer to be fully removed. Low friction guide plates are mounted about the drawer opening for quiet, easy movement thereof.

10 Claims, 6 Drawing Figures

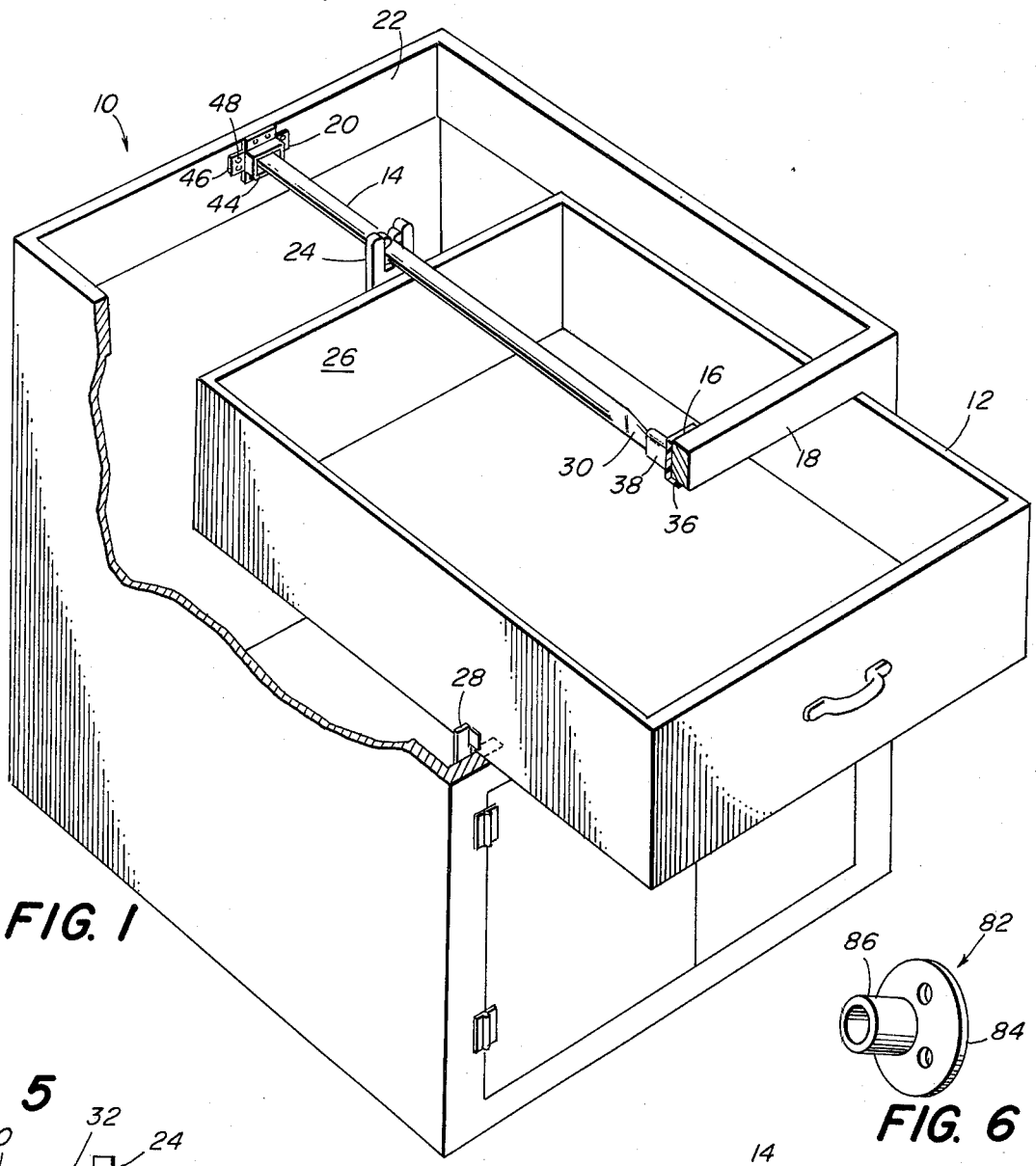
FIG. 1
FIG. 6
FIG. 5
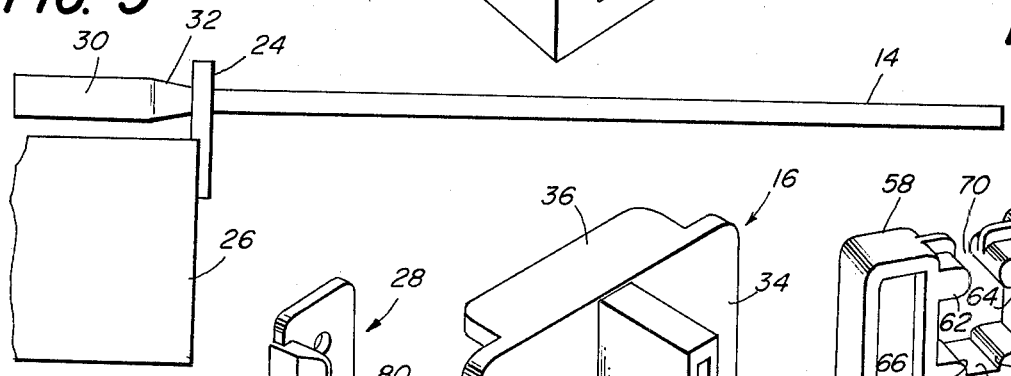
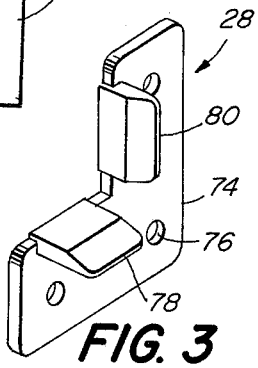
FIG. 3
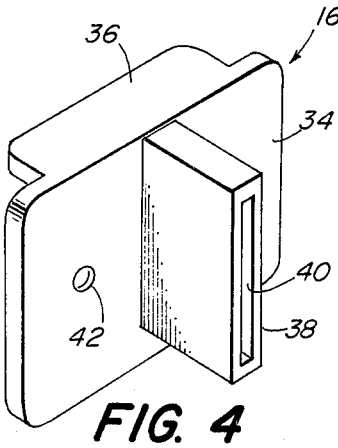
FIG. 4
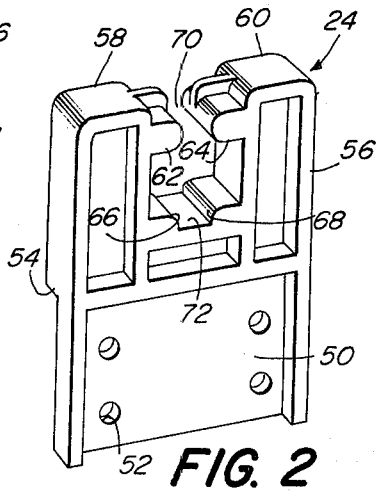
FIG. 2

DRAWER RAIL SYSTEM

BACKGROUND OF THE INVENTION

1. Field of the Invention

This invention relates generally to a drawer guide system and more particularly is directed towards a new and improved drawer rail system utilizing a single self-aligning rail.

2. Description of the Prior Art

Conventional drawer supports usually include a pair of side rails mounted to the cabinet frame on either side of the drawer. The rails engage a fixed slide member on the drawer or, in some instances, rollers are employed in which the guide rollers are mounted to the drawer and ride along the guide rails. While such drawer guides have long been in use, they have a number of drawbacks, particularly from a cost and fabrication standpoint. Drawer construction using rollers generally are incorporated only in more expensive systems and require relatively precision assemblies to insure proper alignment of the components. Further, the rollers must be lubricated periodially to insure continued proper operation. Also, drawers supported by this type of system are frequently difficult to separate from the cabinet and to re-position in the cabinet if the drawer is to be replaced. Even drawers not using rollers but merely fixed slides are also unsatisfactory for several reasons. First of all, the parts must be precisely aligned to insure that the drawer will fit and more properly within the slideway. If the drawer and the cabinet are both wood, the friction between the moving parts is oftentimes objectionable and any warping of the wood frame often will cause the drawer to jamb.

Accordingly, it is an object of the present invention to provide improvements in drawer rail systems. A more specific object of this invention is to provide a simple, low cost drawer rail system which is quick and easy to install, quiet in operation, requires no lubrication and is self-centering to compensate for distortion in the frame or drawer.

SUMMARY OF THE INVENTION

This invention features a drawer rail system comprising a single, tubular drawer rail mounted to the cabinet frame, preferably above the drawer and parallel to it. The forward end of the rail is fixed while the rear end of the rail is free for limited lateral movement by which the drawer and rail can center themselves. A bifurcated drawer guide is attached to the rear wall of the drawer and slidably engages the rail. The rail is flattened in its forward portion to provide a semi-stopping action and permits the drawer to be fully removed from the cabinet by tiltng the drawer. Low friction corner glides are mounted about the cabinet drawer opening for sliding support of the drawer.

BRIEF DESCRIPTION OF THE DRAWINGS

FIG. 1 is a view in perspective, partially cut away, of a drawer rail system made according to the invention and installed in a cabinet, FIG. 2 is a view in perspective of a drawer guide made according to the invention, FIG. 3 is a view in perspective of a corner glide made according to the invention, FIG. 4 is a view in perspective of a front rail bracket made according to the invention, FIG. 5 is a side view of the drawer rail with the drawer guide mounted thereon, and, FIG. 6 is a perspective view of a modified rear bracket,

DETAILED DESCRIPTION OF THE PREFERRED EMBODIMENT

Referring now to the drawings, the reference character 10 generally indicates a cabinet in which is mounted a drawer 12 of typically construction. The illustrated unit is of the type commonly used as a kitchen cabinet, bathroom vanity or the like, although obviously the invention is applicable to any type of storage pieces such as bureaus, chests, file cabinets and the like equipped with one or more drawers.

As shown in the drawings, the drawer 12 is mounted for sliding support by means of a drawer rail system which includes a single elongated rail 14 positioned centrally above the drawer 12 and mounted at its forward end by means of a front bracket 16 attached to a front cabinet frame member 18 and at its rear end the rail 14 is mounted in a rear bracket 20 attached to a rear wall 22 of the cabinet. A bifurcated drawer guide 24 is fixed to a back wall 26 of the drawer 12 and extends above the upper edge thereof to slidably engage the rail 14. Corner glides 28 are mounted to the front frame 18 of the cabinet at opposite lower corners of the drawer opening to slidably support the lower edges of the drawer.

With the exception of the drawer rail 14, which preferably is of tubular steel construction, the remaining parts of the drawer rail system preferably are fabricated as by molding from a suitable plastic material such as polyethelene or the like. Molded polyethelene is strong, durable and displays a smooth, waxy, low friction surface suitable for this purpose.

The rail 14 may be made up in various sizes but in a typical drawer rail system a tubular steel rail of 5/8 inch diameter and approximately 22 inches in length has been found to function satisfactorily. The rail length is determined by the depth of the cabinet and should be sufficient to extends between the inside face of the front frame 18 and the inside face of the rear wall 22 of the cabinet. While the major portion of the rail 14 is in the form of a cylindrical tube, the forward portion is flattened as indicated at 30 for reasons that will presently appear. The flattened portion 30 is oriented vertically and has a length on the order of 3 inches or so. It will be noted that a tapered shoulder 32 is formed between the flattened portion of the rail and the cylindrical portion. The tapered shoulder serves as a temporary stop for the drawer guide 34 to inhibit accidental separation of the drawer from the cabinet.

The front bracket 16 is a molded one-piece affair being formed with a flat flange 34 having a lip 36 extending rearwardly from one long edge thereof and a socket 38 extending medially at right angles from the center forward face thereof. The socket 38 is formed with a deep rectangular slot 40 adapted to receive the flattened forward portion 30 of the rail 14 as best shown in FIG. 1. The flange 34 is also formed with openings 42 to receive nails, screws, staples or other fastening means by which the bracket is mounted permanently to the cabinet frame 18. As best shown in FIG. 1, the bracket is mounted with the lip 36 positioned downwardly and extending forwardly in under the lower edge of the frame 18 in the manner shown.

The socket 38 extends rearwardly into the cabinet to receive the flattened portion of the rail.

The rear bracket 20 is aligned with the front bracket 16 and is formed with a relatively wide and deep socket 44 to loosely receive the rear end of the rail 14. The socket is somewhat rectangular extending horizontally with respect to the cabinet frame and includes outwardly extending flanges 46 with suitable openings 48 by means of which the rear bracket may be nailed, stapled or otherwise fastened to the wall 22. In practice, the height of the socket 44 should be only slightly larger than the diameter of the rail yet considerably wider. Typically, a height of ¾ inch in the socket allows the rear end of the rail to more horizontally but with very little movement vertically. A socket width on the order of 1¼ inches allows considerable play in the lateral movement of the rail by means of which the rail as well as the drawer may align themselves properly with respect to the cabinet despite minor errors in assembly or warpage in the cabinet. The socket 44 may have a depth on the order of ¾ inch or more as desired.

The drawer guide 24 is a more or less flat piece having a lower flange portion 50 with openings 52 to receive fasteners such as screws or the like by means of which the flange portion 52 is attached to the rear wall 26 of the drawer 12. To aid in positioning the drawer guide 24, a shoulder 54 is formed between the lower flange portion 50 and at its upper bifurcated portion 56. In practice, the shoulder 54 is positioned against the top edge of the back wall 26 of the drawer in the manner shown in FIGS. 1 and 5 to insure uniform positioning with respect to the other parts of the system. The bifurcated upper portion 56 includes a pair of upwardly extending parallel legs 58 and 60 of corresponding configuration and including four rounded and oppositely facing bosses 62, 64, 66 and 68 located at opposite corners of the opening formed between the two legs. The rounded bosses serve as bearings to engage the rail 14 at points approximately 90° apart. The upper bosses 62 and 64 define an upper opening at 70 by means of which the drawer may be fully separated from the cabinet.

In normal operation, the drawer guide 24 is free to move along with the drawer to which it is attached over the full cylindrical portion of the rail which would be normal operating range of the drawer. As indicated previously, the tapered shoulder 32 serves as a stop for the drawer guide and the drawer whenever it is pulled forwardly to a near full open position. When the drawer guide 24 reaches the tapered shoulder 32, the lower edge of the shoulder 32 engages a medial section 72 of the bifurcated position 56 forcing the rail upwardly and tightly against the bosses 62 and 64 producing a yielding stop action. By pulling forwardly on the drawer the legs 58 and 60 will spread apart very slightly allowing the drawer guide to pass beyond the shoulder 32 into the flattened portion 30. Once the drawer guide has reached the flat portion, the drawer front may be tilted upwardly in order to pivot the rear portion of the drawer downwardly so that the flat portion 30 may pass through the opening 70 between the legs 58 and 60 of the drawer guide 24 whereby the drawer is fully separated from the cabinet. By reversing the procedure, the drawer may be re-installed Each corner glide 28, as best shown in FIG. 3, includes a flat L-shaped plate 74 having openings 76 for staples, etc., by means of which the glide is fastened to the frame 18, preferably at the lower opposite corners of the drawer openings in the manner shown. The plate 74 is formed with a pair of tapered lips 78, 80, mutually perpendicularly to one another along the inside edges of the plate. The glides are mounted to the inner face of the frame 18 with the lips 78 and 80 positioned one at the lower edge of the drawer opening and the other at the side edge at each corner. In this fashion the drawer is supported at the bottom and side allowing easy movement of the drawer in and out with respect to the cabinet. While only one glide is shown in FIG. 1, it will be understood that a similar glide is mounted in the opposite lower corner of the drawer opening.

The system shown is relatively inexpensive and fabricated primarily of molded parts and simple tubular steel. It is extremely simple to install and yet has the advantage of self-alignment while providing a very easy, smooth motion. The system is extremely guiet in operation and while the rail is shown above the drawer to form a suspension system, it may also be mounted below the drawer with appropriate re-positioning of the brackets and drawer guide, if desired.

In the event that a fixed rail system is desired instead of the self-aligning floating rail of the principal embodiment, a rear bracket 82 as shown in FIG. 6 may be used. The bracket 82 includes a circular flange 84 and a cylindrical socket 86 to snugly receive the rear end of the rail in an immobile mounting.

Having thus described the invention what we claim and desire to obtain by Letters Patent of the United States is:

1. A system for mounting a drawer to a cabinet or the like, comprising a. an elongated rail substantially coextensive with the length of said drawer and mountable to said cabinet in a horizontal plane between the front and back walls of said cabinet parallel to the path of travel of said drawer, b. said rail being cylindrical over a substantial portion thereof and being formed with a vertically and longitudinally flattened portion at the forward end thereof, and, c. a unitary guide fixed to the back wall of said drawer and slidably engaging said rail, d. said guide being formed with a pair of spaced legs with inwardly extending end portions defining a restricted opening therebetween less than the diameter of said cylindrical portion and greater than the thickness of said flattened portion to allow separation of said guide and drawer from said rail at said flattened portion.

2. A system according to claim 1 wherein said rail is formed with a tapered shouler between said cylindrical portion and said flattened portion to provide a yieldable stop for said guide moving against said shoulder.

3. A system according to claim 1 including front and rear brackets mountable to the front and rear walls of said cabinet and supporting opposite ends of said rail.

4. A system according to claim 3 wherein said rear bracket is formed with a relatively wide socket to receive the rear end of said rail and allow limited lateral movement thereof.

5. A system according to claim 1 including low friction corner glides mountable to the front of said cabinet at the corners of the drawer opening.

6. A system according to claim 1 wherein said guide is of a low friction molded plastic material the legs of which are adapted to yield slightly under applied pressure.

7. A system according to claim 5 wherein each of said corner glides is formed with an L-shaped flat plate adapted to be mounted to the vertical inner face of the front cabinet wall and a tapered lip formed perpendicularly to the inner edge of each leg of the plate to bear against the corner edges of the drawer opening.

8. A system according to claim 1 wherein said guide is formed with integral arcuate bosses on the inner opposing sides of said legs and at opposite ends thereof to slidably engage the cylindrical portion of said rail at different angular positions.

9. A system according to claim 8 wherein said guide is formed with an integral transverse shoulder adapted to engage the edge of the back wall of said drawer.

10. A system according to claim 3 wherein said front bracket is formed with a flat flange adapted to be mounted against the inner face of the cabinet front wall, a lip along an edge of said flange to engage the cabinet edge defining the drawer opening and an inwardly projecting socket dimensioned to snugly receive the flattened end of said rail.

* * * * *